United States Patent [19]

Zitser et al.

[11] 4,445,564

[45] May 1, 1984

[54] MACHINE FOR MAKING MOULD CORES FROM FLOWABLE CORE SAND MIXTURES IN HOT MULTIPLE CORE BOXES

[75] Inventors: Vitaly A. Zitser, Dolgoprudny Moskovskoi; Leonid V. Bachelis, Moscow; Alexandr V. Melnikov, Moscow; Eduard A. Stolyar, Moscow; Vladimir S. Kushelman, Moscow; Igor I. Dreishev, Moscow; Vladimir D. Abaskalov, Karaganda; Vladimir A. Levinson, Karaganda; Vladimir A. Ivanov; Jury E. Morozov, both of Moscow, all of U.S.S.R.

[73] Assignee: Tsentralnoe Proektno-Konstruktorskoe I Tekhnologicheskoe Bjuro, Moscow, U.S.S.R.

[21] Appl. No.: 320,077

[22] Filed: Nov. 10, 1981

[51] Int. Cl.[3] ..... B22C 11/04; B22C 13/12

[52] U.S. Cl. ..... 164/186; 164/234

[58] Field of Search ..... 164/234, 186, 410, 305

[56] References Cited

U.S. PATENT DOCUMENTS

| | | | |
|---|---|---|---|
| 3,802,484 | 4/1974 | Ovodov et al. | 164/169 |
| 4,083,396 | 4/1978 | Michelson | 164/186 X |
| 4,103,734 | 8/1978 | Mikotin et al. | 164/341 X |
| 4,184,533 | 1/1980 | Breitbarth | 164/186 X |
| 4,241,779 | 12/1980 | Zitser et al. | 164/207 |
| 4,285,599 | 8/1981 | Zitser et al. | 366/17 |
| 4,308,909 | 1/1982 | Zitser et al. | 164/207 |

FOREIGN PATENT DOCUMENTS

| | | | |
|---|---|---|---|
| 201786 | 1/1959 | Austria | 164/186 |
| 2456574 | 12/1980 | France | 164/186 |
| 351632 | 11/1972 | U.S.S.R. | 164/213 |
| 509334 | 6/1976 | U.S.S.R. . | |

*Primary Examiner*—Gus T. Hampilos
*Assistant Examiner*—J. Reed Batten, Jr.
*Attorney, Agent, or Firm*—Fleit, Jacobson, Cohn & Price

[57] ABSTRACT

A machine for making mould cores from flowable sand mixtures in hot multiple core boxes including a supporting frame carrying a conveyor whereon core boxes are placed, each of the boxes having a top and a bottom piece and mechanically interlinked main and additional gates. The gates are adapted to close or open respectively the central and peripheral core print openings of the core boxes while interacting with their respective individual drives. When the main gate and one of the additional gates interact with their respective individual drives made fast on the supporting frame at the pressing mechanism, they close respectively the central and peripheral core print openings. When the main gate and the other additional gate interact with their other individual drives made fast on the supporting frame before the splitting-up mechanism, they open the central and peripheral core print openings.

2 Claims, 6 Drawing Figures

MACHINE FOR MAKING MOULD CORES FROM FLOWABLE CORE SAND MIXTURES IN HOT MULTIPLE CORE BOXES

TECHNICAL FIELD

The present invention relates generally to core making machines and more specifically to machines for making cores from flowable sand mixtures in hot multiple core boxes.

BACKGROUND OF THE INVENTION

The invention can find application at automobile, sanitary-engineering, electrical-engineering, mechanical-engineering and some other plants, wherein large-scale or mass production is practised.

Known in the present state of the art is a method of making mould cores from flowable sand mixtures, consisting in that the flowable mixture is pressure forced into a pre-heated core box, whereupon the box is sealed tight and the mixture is allowed to stand therein for a lapse of time enough for the mixture to solidify after which the box is opened and the finished core is taken out of it (cf., e.g., U.S. Pat. No. 3,802,484).

Said method is instrumental in making any cores (preferably band-shaped cores) as a whole as a natural vent hole or porosity is formed inside the core in the course of solidification, through which gas venting can occur efficiently.

Known at present is also a machine for making mould cores from flowable sand mixtures in hot multiple core boxes, which carries said method into effect.

The machine incorporates a supporting frame whereon are arranged as along the run of the core production process cycle: a sand mixture preparation mechanism, a mechanism for pressing said mixture in core boxes, a mechanism for splitting up the core boxes and a mechanism for discharge of finished cores. Said supporting frame carries also a means of conveyance of the core boxes along the run of the core production process cycle whereon the core boxes are placed. Each of the core boxes has a top piece and a bottom piece, the former piece having central and peripheral core print openings. Provision is also made in the machine for a gate situated on the top piece of the core box so as to interact with an individual drive made fast on the supporting frame at the pressing mechanism in order to close the central core print openings, and with another individual drive made fast on the supporting frame before the splitting-up mechanism so as to open the central core print openings. The machine comprises also a means adapted to shut up the peripheral core print openings in the core boxes (cf., e.g., USSR Inventor's Certificate No. 509334).

In the afore-discussed machine the means for shutting up the peripheral core print openings is made as heated plugs.

The afore-discussed machine incorporates a rotary wire brush arranged before the splitting-up mechanism.

The machine operates as follows.

The original constituents of the sand mixture are fed to the mixture preparing mechanism. The thus-prepared flowable sand mixture is delivered to the pressing mechanism, wherefrom the mixture is forced into a preheated core box through its central core print openings. When the mixture is pressed into the box the peripheral core print openings are shut up with heated plugs which contributes to an efficient growth of a solid skin at the ends of these openings. Pressing of the mixture having been over the core box is allowed to stand for a while, whereupon the gate shuts up the central core print openings after having been actuated by an individual drive, and the core box is transferred by the conveyance means to a next technological station. While being transferred to that station the top piece of the core box is cleaned of the mixture remainder with the rotary brush. Then another individual drive turns the gate to open the central core print openings, the core box is split up, the finished cores are taken out of it and are carried away from the core box zone by the core discharge mechanism. Next the core is reassembled and returned by the conveyance means for a next sand mixture pressing operation. Thus, a whole cycle is repeated.

In the machine under discussion, in order to provide a solid skin of a required thickness at the ends of the peripheral core prints, it is necessary to substantially prolong the time of contact of the mixture with the heated plugs which results in an increased stay time of a core box at the station of the pressing mechanism and hence in a reduced output of the machine.

Furthermore when cleaning the top piece of the core box from the remainder of the mixture with the rotary brush, it is fraught with a danger of damaging the already formed skin at the exposed ends of the peripheral core prints, or even breakage of said skin with the spoiled cores as a result.

SUMMARY OF THE INVENTION

It is an object of the present invention to provide higher production output of a machine for making mould cores from flowable sand mixtures.

It is another object of the present invention to provide better quality of mould cores produced by the machine for making cores from flowable sand mixtures in hot multiple core boxes.

The aforesaid objects are accomplished due to the fact that in a machine for making mould cores from flowable sand mixtures in hot multiple core boxes, comprising a supporting frame whereon there are arranged as along the run of the core production process cycle the following mechanisms: a sand mixture preparation mechanism, a mechanism for pressing the sand mixture in core boxes, a mechanism for splitting up the core boxes and a mechanism for discharge of finished mould cores, said supporting frame also carrying a means of conveyance of the core boxes along the run of the core production process cycle so that said core boxes are placed on said conveyance means, each of the core boxes having a top piece and a bottom piece, the former piece being provided with central core print openings and peripheral core print openings, and a main gate provided on the top piece of the core box so as to interact with an individual drive made fast on the supporting frame at the pressing mechanism in order to close the central core print openings, and with another individual drive made fast on the supporting frame before the splitting-up mechanism in order to open the central core print openings, as well as comprising a means for shutting up the peripheral core print openings in the core boxes, according to the present invention, provision is also made therein for further two individual drives of which one drive is secured on the supporting frame at the pressing mechanism, while the other drive is situated before the splitting-up mechanism, and the means to shut up the peripheral core print openings in the core boxes is made as additional gates mechanically interlinked through a pullrod and located on the top piece of the core boxes, one of said additional gates being adapted to interact with the individual drive located at the pressing mechanism so as to shut up the peripheral core print openings in the core boxes, while the other additional gate is adapted to interact with the other individual drive located before the splitting-up mechanism so as to open the peripheral core print openings in the core boxes.

It is expedient that the individual drives located before the splitting-up mechanism be made as a single drive common to all the gates and adapted to interact with one of the additional gates; that the pullrod mechanically interlinking the additional gates be provided with an adjustable stop; and that the main gate have a tailpiece adapted to interact with the adjustable stop at the instance when the common drive actuates one of the additional gates.

Such a constructional arrangement of the machine for making mould cores from flowable sand mixtures in hot multiple core boxes makes it possible to minimize the staying period of a core box at the station of the pressing mechanism, to prevent a danger of destructing the solid skin on the mixture at the ends of the peripheral core prints with a rotary brush and thereby to increase the output of the machine and improve the quality of mould cores produced thereon.

BRIEF DESCRIPTION OF THE DRAWINGS

Said and other objects of the present invention will be apparent hereinafter from a consideration of some specific embodiments thereof and of the accompanying drawing, wherein.

DETAILED DESCRIPTION OF THE INVENTION

Figure 1:
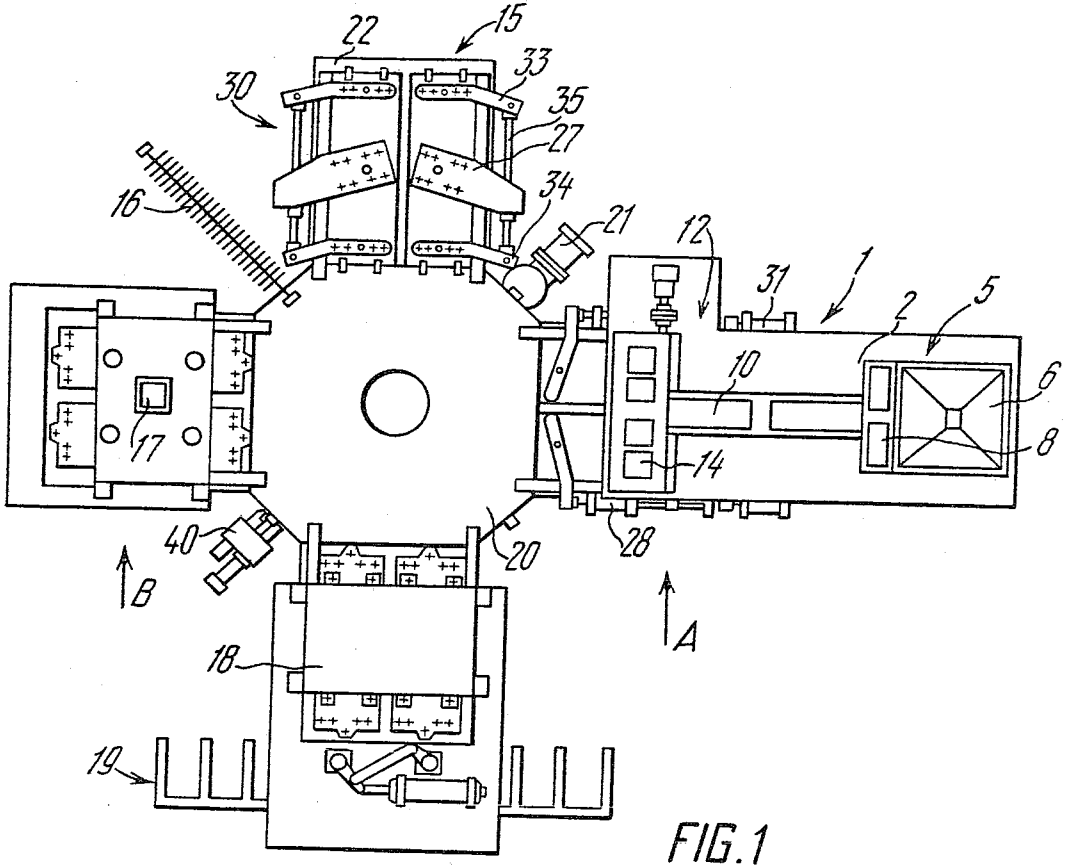
FIG. 1 is a general schematic plan view of a machine for making mould cores from flowable sand mixtures, according to the present invention.

The machine for making mould cores from flowable sand mixtures in hot multiple core boxes, according to the present invention, comprises a supporting frame 1 (FIG. 1) made up of a top member 2, a bottom member 3 (FIG. 2) and pillars 4 interconnecting both members.

The top member 2 (FIG. 1) of the supporting frame 1 carries the following mechanisms arranged as along the run of the core production process cycle: a mixture preparing mechanism 5 having a sand hopper 6 (FIG. 2) with a feeder 7, tanks 8 for liquid constituents with feeders 9, a mixer 10 and a bulk distributor 11, and a mechanism 12 (FIG. 1) for pressing the sand mixture in core boxes, said mechanism 12 having mixture proportioning chambers 13 (FIG. 2) and drives 14 for pressing the mixture in core boxes 15. Further on the top member 2 (FIG. 1) of the supporting frame 1 there are arranged as along the run of the core production process cycle: a rotary wire brush 16, a mechanism 17 for venting the cores accommodated in the core boxes 15, a mechanism 18 for splitting up the core boxes 15 and a mechanism 19 for discharge of finished cores.

Figure 2:
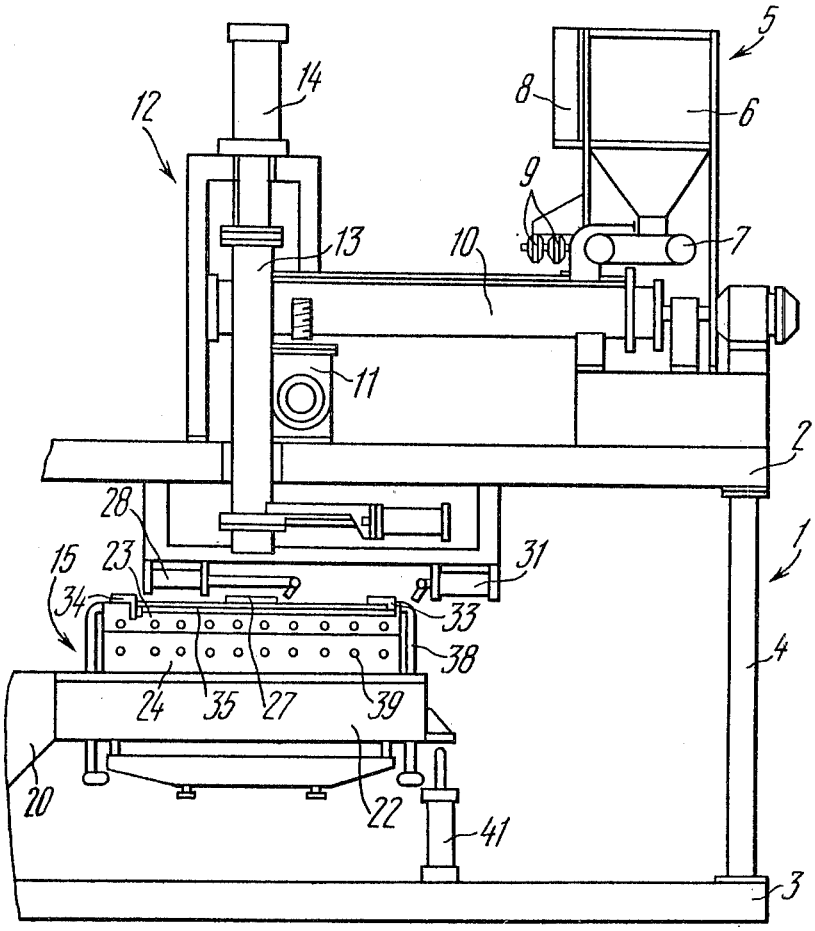
FIG. 2 is a view taken along the direction of the arrow A in FIG. 1.

A means 20 of conveyance is located on the bottom member 3 (FIG. 2) of the supporting frame 1, adapted to transfer the core boxes 15 along the run of the core production process cycle and made as a merry-go-round mechanism traversable with respect to the bottom member 3 from a drive 21 (FIG. 1).

Figure 3:
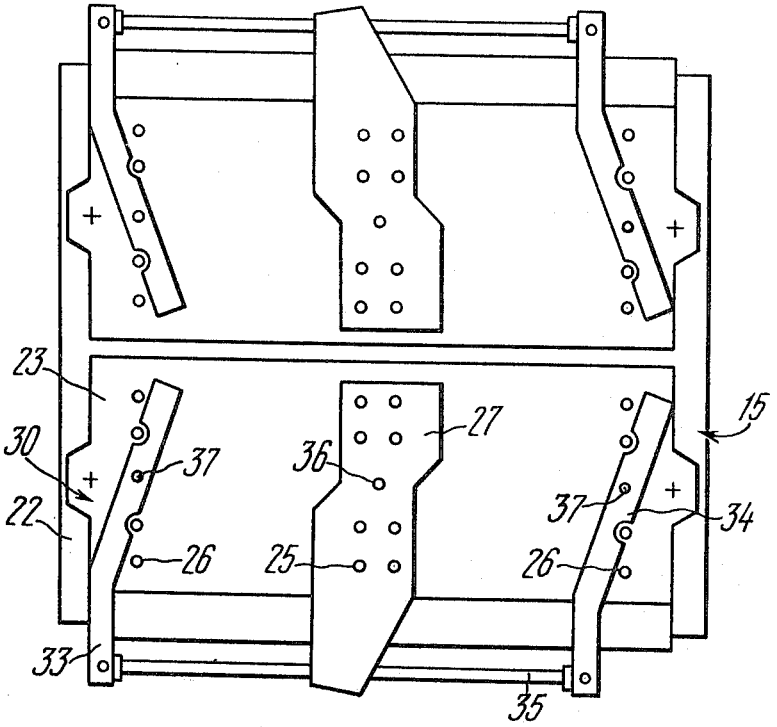
FIG. 3 is a plan view of a multiple core box of the machine, according to the present invention, while at the station of the splitting-up mechanism of said machine.

The conveyance means 20 (FIG. 2) has four brackets 22, each carrying two core boxes 15 (FIG. 3). Each of the core boxes 15 (FIG. 2) has a top piece 23 and a bottom piece 24. The top piece 23 (FIG. 3) of the core box 15 is provided with central core print openings 25 and peripheral core print openings 26. A gate 27 is turnably mounted on the top piece 23 of the core box 15 so as to interact with an individual drive 28 (FIG. 2) made fast on the top member 2 of the supporting frame 1 at the pressing mechanism 12 in order to close central core print openings 25, and with an individual drive 29 (FIG. 4) secured on the top member 2 (FIG. 1) of the supporting frame 1 before the splitting-up mechanism 18 (in a given particular case at the core venting mechanism 17) in order to open the central core print openings 25 as it is shown respectively in FIGS. 5 and 3.

Figure 4:
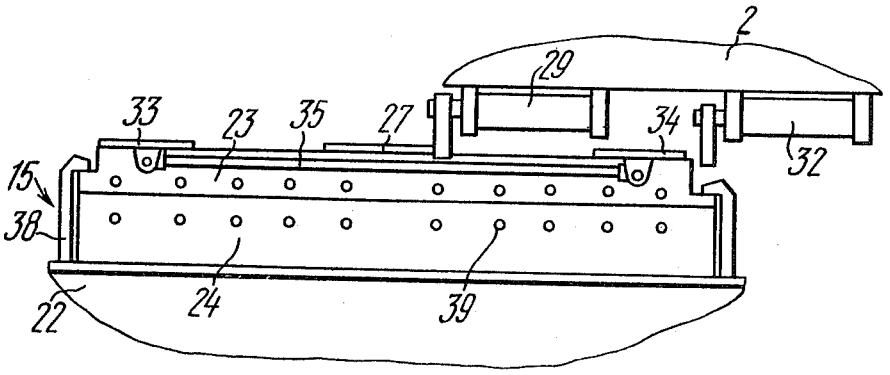
FIG. 4. is a view taken along the direction of the arrow B in FIG. 1.

Provision is made in the machine, according to the present invention, for a means 30 (FIG. 3) adapted to shut up the peripheral core print openings 26 in the core boxes 15 and for further two individual drives 31 (FIG. 2) and 32 (FIG. 4).

The drive 31 (FIG. 2) made fast on the top member 2 of the supporting frame 1 at the pressing mechanism 12. The drive 32 (FIG. 4) is also made fast on the top member 2 (FIG. 1) of the supporting frame 1 but before the splitting-up mechanism 18, in a given particular case at the core venting mechanism 17.

The means 30 (FIG. 3) adapted to shut up the peripheral core print openings 26 in the core boxes 15 is made as gates 33 and 34 mechanically interlinked through a pullrod 35. The gates 33 and 34 turnably mounted on the top piece 23 of the core boxes 15.

Figure 5:
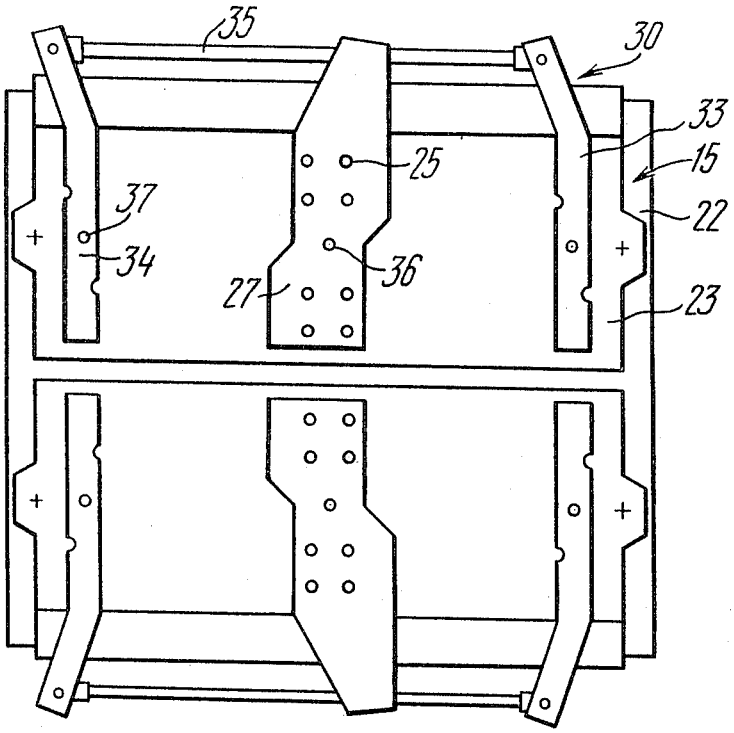
FIG. 5 is a plan view of a multiple core box of the machine, according to the present invention, while at the station of the sand mixture pressing mechanism of said machine.

The gate 33 (FIG. 2) is adapted to interact with the individual drive 31 located at the pressing mechanism 12 in order to close the peripheral core print openings as shown in FIG. 5, while the gate 34 (FIG. 4) is adapted to interact with the individual drive 32 situated at the core venting mechanism 17 in order to open the peripheral core print openings in the core boxes 15 as shown in FIG. 3.

The gates 27 and 33, 34 are turnable round their respective pivot pins 36 and 37.

The machine disclosed herein comprises also a means 38 made fast on each of the brackets 22 and adapted to hold the top piece 23 (FIG. 2) of the core boxes 15 together with the bottom piece 24 thereof. The core boxes 15 are preheated by heater elements 39 built into the top pieces 23 and bottom pieces 24 of the core boxes 15.

The conveyance means 20 (FIG. 1) is locked at every station of the core production process cycle by means of a lock 40 adapted to interact with said means 20.

Hydraulic rests 41 located at the pressing mechanism 12 are provided on the bottom member 3 of the machine supporting frame 1 to give additional support to the bracket 22 (FIG. 2) at the instance when the sand mixture is being pressed.

Figure 6:
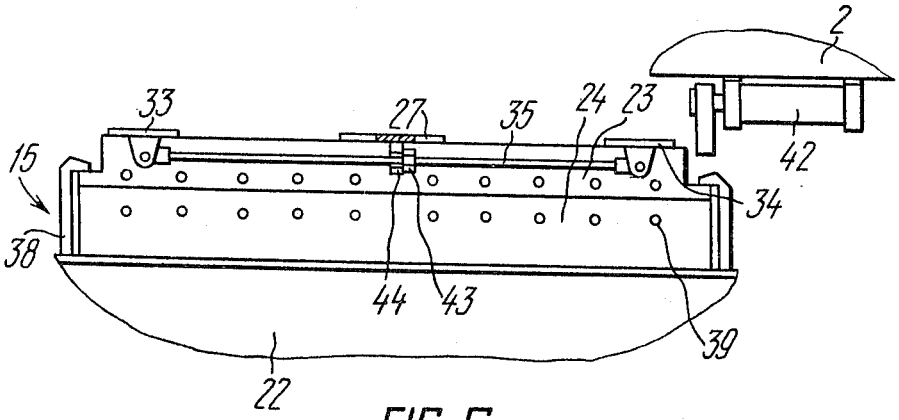
FIG. 6 is a view of another embodiment of the machine, according to the present invention, as shown in FIG. 4.

However, it is more efficient to make use of the machine, according to the present invention, wherein the individual drives located before the splitting-up mechanism 18 (FIG. 1), in a given particular case at the core venting mechanism 17, are made as a single drive 42 common to all the gates 27 (FIG. 6), 33 and 34 and adapted to interact with either of the gates 33 and 34, viz, with the gate 34. An adjustable stop is provided on the pullrod 35 that mechanically interlinks the gates 33 and 34. The gate 27 has a tailpiece 44 adapted to interact with the stop 43 at the instance when the common drive 42 actuates the gate 34.

In all other respects the embodiment of the machine is similar to that of FIG. 1 as to constructional arrangement.

The operational principle of the machine for making mould cores from flowable sand mixtures in hot multiple core boxes, according to the present invention, resides in the following.

Sand from the hopper 6 (FIG. 2) is delivered by the feeder 7 to the continuous-action mixer 10 to which are also fed the liquid constituents from the tanks through the feeders 9. The thus-prepared flowable sand mixture is forwarded from the mixer 10 to the bulk distributor 11, from whence the mixture is dispensed to the proportioning chambers 13 of the pressing mechanism 12.

The core box 15 situated on the bracket 22 is transferred by the conveyance means 20 to the pressing station with its top piece 23 and bottom piece 24 held together by the means 38, while the gates 27 (FIG. 3), 33 and 34 of the core box 15 are in such a position that the central core print openings 25 and the peripheral core print openings 26 thereof are open.

Further on the following operations take place. The drive 31 (FIG. 2) actuates the gate 33 and through the pull-rod 35 also the gate 34, thus causing the both gates to turn round their pivot pins 37 (FIG. 5) so as to shut up the peripheral core print openings 26. The hydraulic rests 41 (FIG. 2) while eliminating the free play, take up the bracket 22, the proportioning chambers 13 descend upon the gate 37 of the core box 15 and the flowable sand mixture is pressed out of them into the core box 15 through the central core print openings 25 by virtue of the drive 14.

The pressing-in operation over the drive 28 actuates the gate 27 to turn it round the pivot pin 36 (FIG. 5) so as to close the openings 25. The hydraulic rests 41 (FIG. 2) return down to the initial positions, whereas the proportioning chambers 13 move up to the initial position. The conveyance means 20 transfers the core box 15 with the pressed-up cores first to an intermediate station, then to the core venting mechanism 17 (FIG. 1), before which the rotary wire brush 16 is situated to remove the remainder of the sand mixture from the top surface of the core box 15.

The following operations are carried out at the station of the core venting mechanism 17. The drive 29 (FIG. 4) actuates the gate 27 to turn it round the pivot pin 36 (FIG. 3) so as to open the openings 25; the drive 32 (FIG. 4) actuates the gate 34 and through the pullrod 35 also the gate 33 to turn both of the gates round their pivot pins 37 (FIG. 3) so as to open the openings 26, whereupon the core venting mechanism 17 (FIG. 1) pricks the core prints to communicate their interior space with the atmosphere.

Further on the core box 15 is transferred by the conveyance means 20 to the station of the splitting-up mechanism 18 so that the means 38 (FIG. 2) releases the top piece 23 and the bottom piece 24 of the core box 15 to disengage them from each other.

The following operations are carried out at the station of the splitting-up mechanism 18 (FIG. 1): raising of the top piece 23 of the core box 15 along with the cores by the splitting-up mechanism 18; bringing of the core discharge mechanism 19 under the cores; placing of the cores on the core discharge mechanism 19; carrying the cores away from the zone of the core box 15; and reassembling of the core box 15.

Next the core box 15 is transferred by the conveyance means 20 again to the pressing mechanism 12, the top piece 23 and the bottom piece 24 of the core box 15 are held together through the means 38, and the entire cycle starts once more again.

Another operating cycle of the machine consists in that the following operations occur at the station of the core venting mechanism 17. The drive 42 (FIG. 6) actuates the gate 34 and through the pullrod also the gate 33 to turn them round their pivot pins 37 so as to open the openings 26. At the same time the adjustable stop 43 provided on the pullrod 35 engages the tailpiece 44 of the gate 27 as as to turn the latter round the pivot pin 36 and open the openings 25. In every other respect the operation of the machine is quite similar to that described above.

The machine disclosed in the present invention enables a substantial (by 30 to 40 percent) increase in the output and a better quality of cores produced.

In describing the particular embodiment of the present invention specific narrow terminology has been resorted to for the sake of clarity. However, it is not intended to be limited to the specific terms so selected, and it is to be understood that each such term covers all equivalent elements operating in a similar way to accomplish similar purposes.

While a preferred embodiment of the present invention has been disclosed in the foregoing description, it will be understood that various modifications and versions may occur to those skilled in the art without departing from the spirit and scope of the present invention.

All such alterations and changes shall be considered to remain within the limits of the spirit and scope of the invention and the claims that follow.

What is claimed is:

1. A machine for making mould cores from flowable sand mixtures in hot multiple core boxes, comprising:

a supporting frame;

a conveyance means provided on said supporting frame for carrying core boxes for transfer along a path of the core production process cycle;

mechanisms mounted on said supporting frame and arranged along the path of the core production process cycle, said conveyance means transferring said core boxes to said mechanisms, said mechanisms comprising:

a sand mixture preparation mechanism, a mechanism for pressing a sand mixture in said core boxes, a mechanism for splitting up said core boxes, and a mechanism for discharge of finished cores;

each of said core boxes having:

a top piece, a bottom piece, said top piece having central core print openings provided therein, said top piece including peripheral core print openings therein on both sides of said central core print openings, a first gate adapted to close or open said central core print openings and installed on said top piece, and a means adapted to close or open said peripheral core print openings and comprising:

a second gate situated on said top piece and adapted to close or open said peripheral core print openings situated on one side of said central core print openings, a third gate located on said top piece and mechanically interlinked with said second gate, and also adapted to close or open peripheral core print openings situated on the other side of said central core print openings, and a pullrod effecting mechanical interlinkage of the second and third gates;

a first individual drive means secured to said supporting frame at said pressing mechanism and adapted to engage said first gate for closing said central core print openings;

a second individual drive means secured to said supporting frame before said core box splitting-up mechanism and adapted to engage said first gate for opening said central core print openings;

a third individual drive means secured to said supporting frame at said pressing mechanism and adapted to engage one of said second and said third gates for opening said peripheral core print openings; and a fourth individual drive means secured to said supporting frame before said core box splitting-up mechanism and adapted to engage one of said third and said second gates for closing said peripheral core print openings.

2. The machine as claimed in claim 1, wherein said second and fourth drive means are made as a single drive common to the first gate, second gate and third gate and adapted to engage one of the second and third gates;

said pullrod includes an adjustable stop; and said first gate includes a tailpiece adapted to engage said adjustable stop when said common drive actuates one of the second and third gates.

* * * * *